US007911123B2

(12) United States Patent
Ryu et al.

(10) Patent No.: US 7,911,123 B2
(45) Date of Patent: Mar. 22, 2011

(54) ELECTRON EMISSION DEVICE AND ELECTRON EMISSION DISPLAY USING THE ELECTRON EMISSION DEVICE

(75) Inventors: Kyung-Sun Ryu, Chunan-si (KR); Kyu-Won Jung, Chunan-si (KR); Il-Hwan Kim, Chunan-si (KR); Si-Myeong Kim, Chunan-si (KR); Ho-Su Han, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 856 days.

(21) Appl. No.: 11/481,702

(22) Filed: Jul. 5, 2006

(65) Prior Publication Data

US 2007/0001575 A1 Jan. 4, 2007

(30) Foreign Application Priority Data

Jul. 4, 2005 (KR) ..... 10-2005-0059860
Oct. 21, 2005 (KR) ..... 10-2005-0099488

(51) Int. Cl.
*H01J 17/49* (2006.01)

(52) U.S. Cl. ..... 313/495; 313/497

(58) Field of Classification Search ..... 313/495–497
See application file for complete search history.

(56) References Cited

U.S. PATENT DOCUMENTS

| | | | | | |
|---|---|---|---|---|---|
| 5,578,900 | A * | 11/1996 | Peng et al. | ..... | 313/495 |
| 5,601,466 | A * | 2/1997 | Shen et al. | ..... | 445/24 |
| 5,614,781 | A * | 3/1997 | Spindt et al. | ..... | 313/422 |
| 5,838,095 | A * | 11/1998 | Tanaka et al. | ..... | 313/309 |
| 5,994,834 | A * | 11/1999 | Alwan et al. | ..... | 313/497 |
| 6,331,135 | B1 * | 12/2001 | Sabde et al. | ..... | 451/41 |
| 6,465,941 | B1 * | 10/2002 | Kubota et al. | ..... | 313/309 |
| 6,534,913 | B1 * | 3/2003 | Perrin et al. | ..... | 313/497 |
| 6,819,041 | B2 * | 11/2004 | Kajiwara | ..... | 313/496 |
| 2003/0184357 | A1 * | 10/2003 | Dijon et al. | ..... | 327/301 |
| 2005/0264171 | A1 * | 12/2005 | Hwang | ..... | 313/497 |
| 2006/0066217 | A1 * | 3/2006 | Son | ..... | 313/497 |

* cited by examiner

*Primary Examiner* — Anne M Hines
(74) *Attorney, Agent, or Firm* — Christie, Parker & Hale, LLP

(57) ABSTRACT

An electron emission device includes a substrate, cathode electrodes formed on the substrate, electron emission regions electrically coupled to the cathode electrodes, an insulation layer formed on the substrate while covering the cathode electrodes, and gate electrodes formed on the insulation layer and crossing the cathode electrodes. One or more gate holes are formed at each of crossing regions of the gate electrodes and the cathode electrodes through the insulation layer and the gate electrodes. At least one of the cathode electrodes includes at least two openings divided by a bridge. The at least two openings divided by the bridge are formed on each exposed region of the cathode electrodes through the gate holes. A corresponding one of the electron emission regions contacts the bridge and extends toward the walls of at least one of the openings but is spaced away from the cathode electrodes.

9 Claims, 19 Drawing Sheets

ELECTRON EMISSION DEVICE AND ELECTRON EMISSION DISPLAY USING THE ELECTRON EMISSION DEVICE

CROSS-REFERENCES TO RELATED APPLICATION

This application claims priority to and benefit of Korean Patent Application Nos. 10-2005-0059860 and 10-2005-0099488 filed on Jul. 4, 2005 and Oct. 21, 2005, respectively, in the Korean Patent Intellectual Property Office, the entire contents of which are incorporated herein by reference.

BACKGROUND OF THE INVENTION

1. Field of the Invention

The present invention relates to an electron emission device and an electron emission display using the electron emission device.

2. Description of Related Art

Generally, electron emission elements are classified into those using hot cathodes as an electron emission source, and those using cold cathodes as the electron emission source. There are several types of cold cathode electron emission elements, including Field Emitter Array (FEA) elements, Surface Conduction Emitter (SCE) elements, Metal-Insulator-Metal (MIM) elements, Metal-Insulator-Semiconductor (MIS) elements, and Ballistic Electron Emitting (BSE) elements.

Typically, the electron emission elements are arrayed to form an electron emission device with a first substrate. The electron emission device is combined with a second substrate, on which a light emission unit having phosphor layers and an anode electrode are formed, to form an electron emission display.

That is, the typical electron emission device includes electron emission regions and a plurality of driving electrodes functioning as scan and data electrodes. The electron emission regions and the driving electrodes are operated to control the on/off operation of each pixel and the amount of electron emission.

The electron emission display excites phosphor layers using the electrons emitted from the electron emission regions to display an image.

The cathode electrode of the electron emission device is typically formed of a transparent conductive material such as indium tin oxide (ITO).

However, when the size of an electron emission display is increased, the length of the cathode electrode also increases. In this case, there may be a high voltage drop due to the high resistance of the ITO used to form the cathode electrode. As a result, the electron emission uniformity along a longitudinal direction of the cathode electrode is deteriorated. This may cause a luminance non-uniformity (or difference) between the pixels of the electron emission display.

SUMMARY OF THE INVENTION

An aspect of the present invention provides an electron emission device that can improve electron emission uniformity of pixels and reduce a line resistance of cathode electrodes.

An aspect of the present invention also provides an electron emission display having the electron emission device.

According to an exemplary embodiment of the present invention, an electron emission device is provided. The electron emission device includes: a substrate; a cathode electrode formed on the substrate; an electron emission region connected to the cathode electrode; an insulation layer formed on the substrate to cover the cathode electrode and having an opening to expose the electron emission region; and a gate electrode formed on the insulation layer, wherein the cathode electrode includes a metal electrode formed on the substrate and a resistive layer formed on the metal electrode and connected to the electron emission region.

The metal electrode may include two line electrodes spaced apart from each other.

The metal electrode may be provided with a plurality of holes spaced apart from each other along a longitudinal direction of the metal electrode.

The resistive layer may include a first resistive layer covering the metal electrode and a second resistive layer formed in the holes of the metal electrode and connected to the first resistive layer.

The second resistive layer may fill the holes of the metal electrode, and is connected to the first resistive layer.

According to another exemplary embodiment of the present invention, there is provided an electron emission display including: a first substrate; a second substrate facing the first substrate; a metal electrode formed on the first substrate and having a plurality of holes arranged along a longitudinal direction of the metal electrode; a resistive layer formed on the metal electrode to fill the holes of the metal electrode; an electron emission region connected to the resistive layer; an insulation layer formed on the first substrate and having an opening to expose the electron emission region; a gate electrode formed on the insulation layer; a plurality of phosphor layers formed on the second substrate; and an anode electrode formed on the phosphor layers.

According to still another exemplary embodiment of the present invention, there is provided an electron emission device including: a cathode electrode formed by depositing a conductive material on a substrate; a sub-electrode formed by depositing a metal oxide material on the cathode electrode; a first insulation layer formed by depositing an insulation material on the sub-electrode and having an insulation hole to expose a portion of the cathode electrode; a first gate electrode formed by depositing a metal material on the first insulation layer; and an electron emission region formed on the portion of the cathode electrode exposed through the insulation hole.

The sub-electrode may be formed of $TiO_2$ or TiN.

According to still yet another exemplary embodiment of the present invention, there is provided an electron emission device including: a sub-electrode formed by depositing a metal material on a substrate; a metal oxide layer formed by depositing a metal oxide material on the sub-electrode; a first insulation layer formed on the metal oxide layer and having an insulation hole to expose a portion of the metal oxide layer; a first gate electrode formed by depositing a metal material on the first insulation layer; and an electron emission region formed on the portion of the metal oxide layer exposed through the insulation hole of the first insulation layer.

The metal oxide layer may be formed of $TiO_2$, TiN, or $SiO_2$.

According to still another exemplary embodiment of the present invention, there is provided an electron emission device including: a sub-electrode formed by depositing a metal material on a substrate; a cathode electrode formed by depositing a conductive material on the substrate to cover the sub-electrode; a first insulation layer formed on the cathode electrode and having an insulation hole to expose a portion of the cathode electrode; a first gate electrode formed by depositing a metal material on the first insulation layer; and an electron emission region formed on the portion of the cathode electrode exposed through the insulation hole.

According to still yet another exemplary embodiment of the present invention, there is provided an electron emission device including: a sub-electrode formed by depositing a metal material on a substrate; a transparent conductive layer formed on the sub-electrode; a first insulation layer formed on the transparent conductive layer and having an insulation hole to expose a portion of the transparent conductive layer; a first gate electrode formed by depositing a metal material on the first insulation layer; and an electron emission region formed on the portion of the transparent conductive layer exposed through the insulation hole.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, certain embodiments of the present invention are shown and described, by way of illustration. As those skilled in the art would recognize, the described embodiments may be modified in various ways, all without departing from the spirit or scope of the present invention. Accordingly, the drawings and description are to be regarded as illustrative in nature, rather than restrictive.

Figure 1:
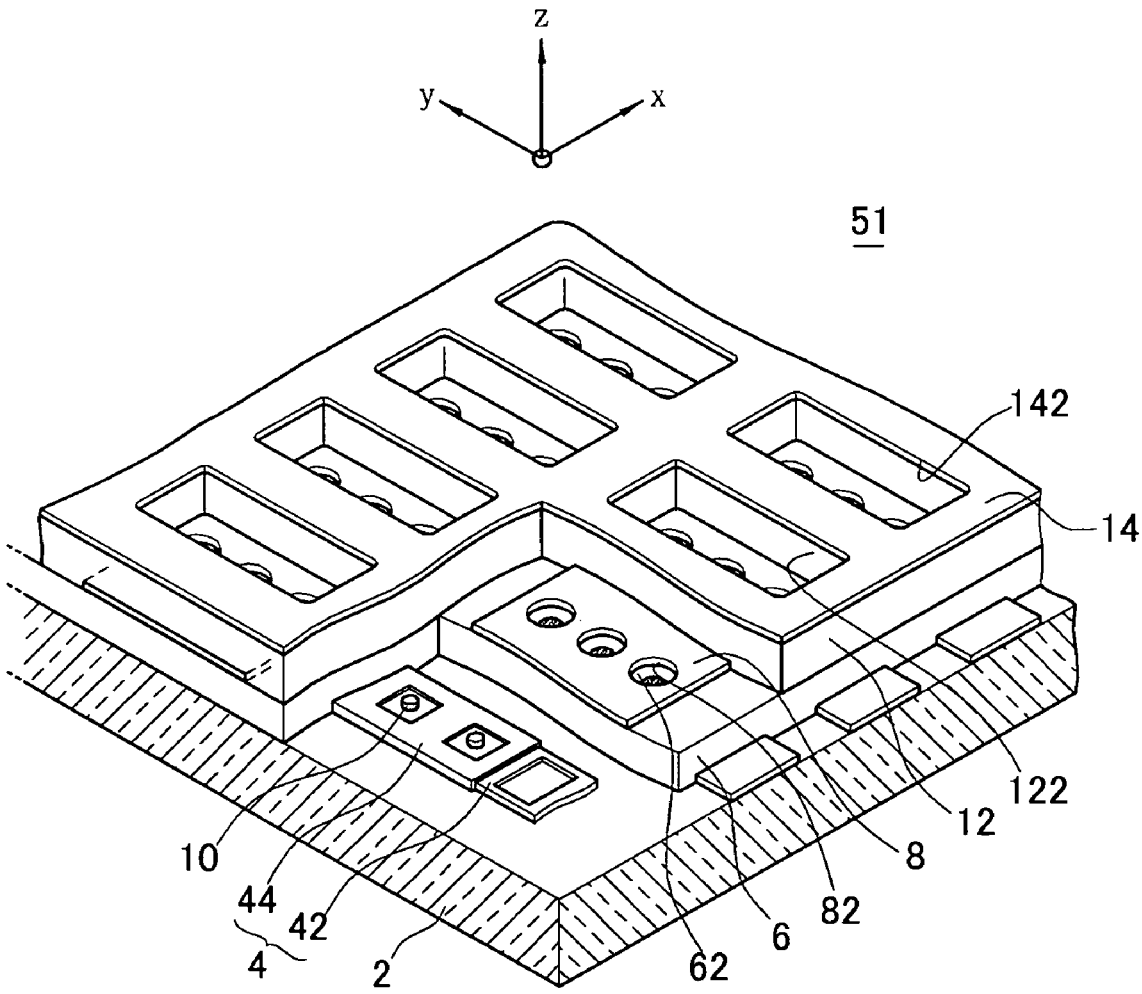
FIG. 1 is a partial exploded perspective view of an electron emission device according to an embodiment of the present invention.
Figure 2:
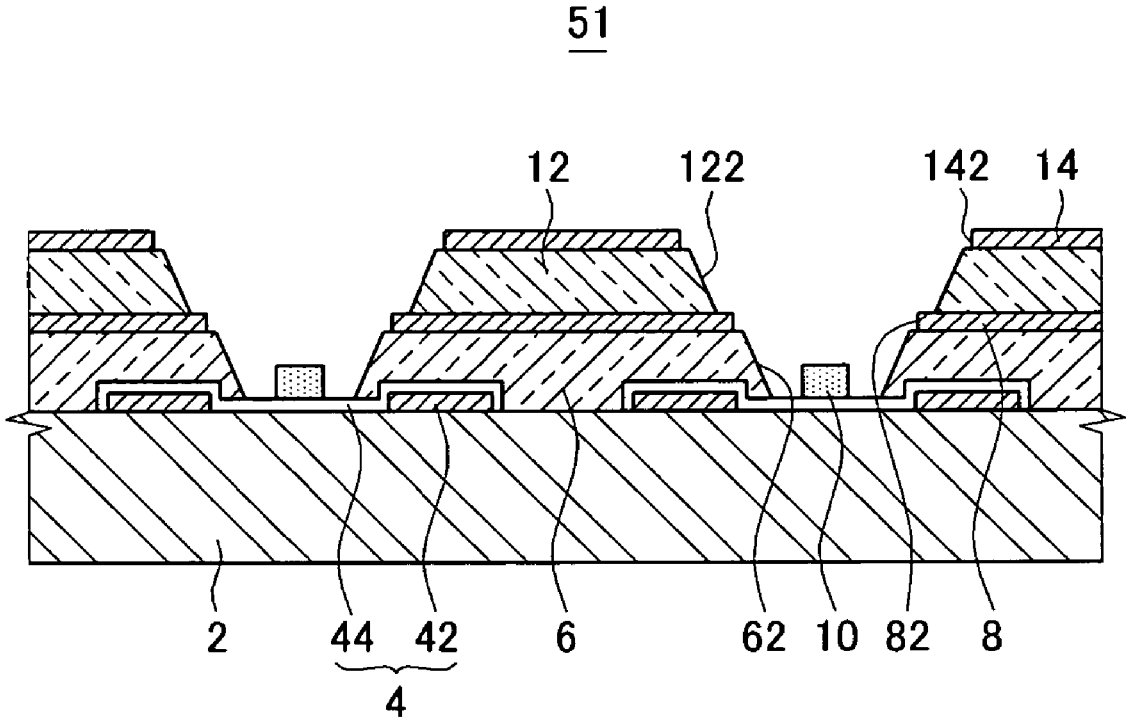
FIG. 2 is a partial sectional view of the electron emission device of FIG. 1.

FIGS. 1 and 2 show an electron emission device 51 according to an embodiment of the present invention.

Referring to FIGS. 1 and 2, the electron emission device 51 includes a substrate 2 on which electron emission elements are arrayed.

That is, cathode electrodes 4 are arranged on the substrate 2 in a stripe pattern extending in a first direction (e.g., in a y-axis direction of FIG. 1) and an insulation layer 6 is formed on the substrate 2 to cover the cathode electrodes 4.

Gate electrodes 8 are formed on the insulation layer 6 in a stripe pattern extending in a second direction (e.g., in an x-axis of FIG. 1) to cross the cathode electrodes 4 at right angles.

One or more electron emission regions 10 are formed on the cathode electrodes 4 at crossing regions of the cathode and gate electrodes 4 and 8. Openings 62 and 82 corresponding to the electron emission regions 10 are respectively formed on the insulation layer 6 and the gate electrode 8 to expose the electron emission regions 10 on the substrate 2.

In this embodiment, multiple electron emission regions 10 are formed on each of crossing regions. The electron emission regions 10 are formed in a circular shape and arranged in a longitudinal direction of the corresponding cathode electrode 4. However, the number, shape, and arrangement of the electron emission regions 10 are not limited to the above embodiment, and the present invention is not thereby limited.

In this embodiment, each of the cathode electrodes 4 includes a metal electrode 42 for receiving an external driving voltage and a resistive layer 44 formed on the metal layer 42 to isolate the metal electrode 42 from the insulation layer 6.

Figure 3:
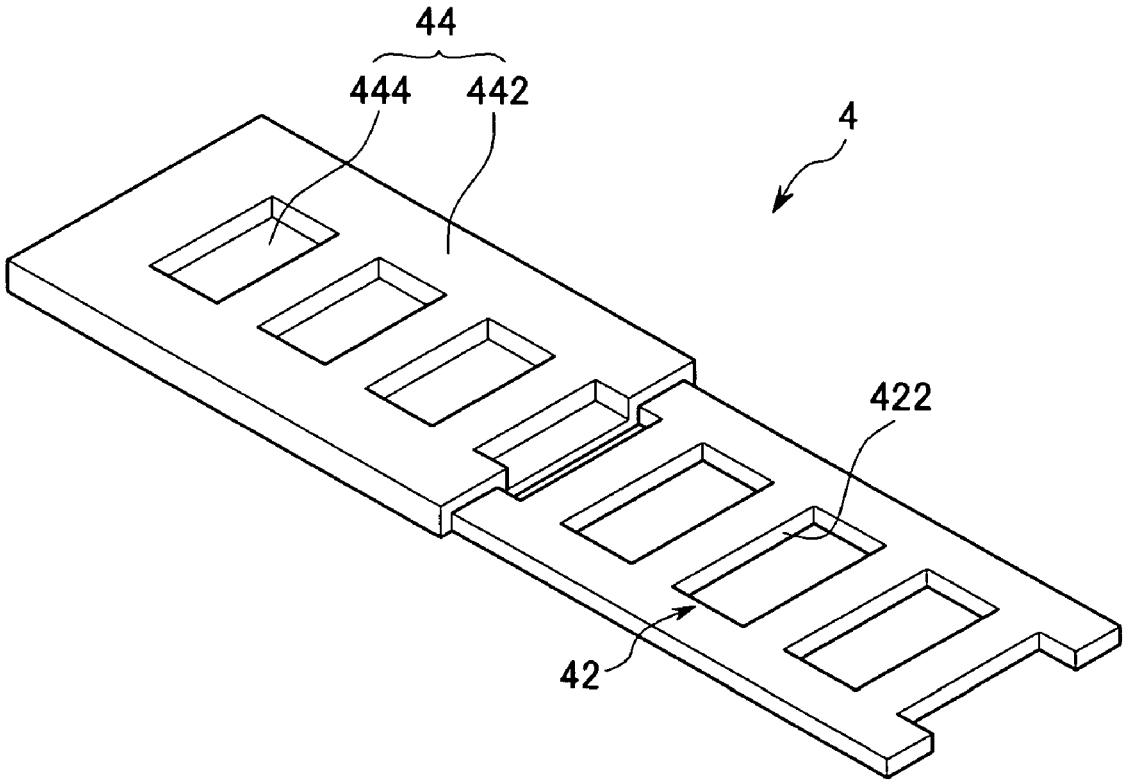
FIG. 3 is a partially broken perspective view of a cathode electrode of the electron emission device of FIG. 1.

As shown in FIG. 3, the metal electrode 42 includes holes 422 arranged along a longitudinal direction thereof and spaced apart from each other by a distance (or a predetermined distance) therebetween. The holes 422 may be formed in, for example, a rectangular shape.

Therefore, as shown in FIG. 3, the overall shape of the metal electrode 42 may be a ladder shape.

Figure 4:
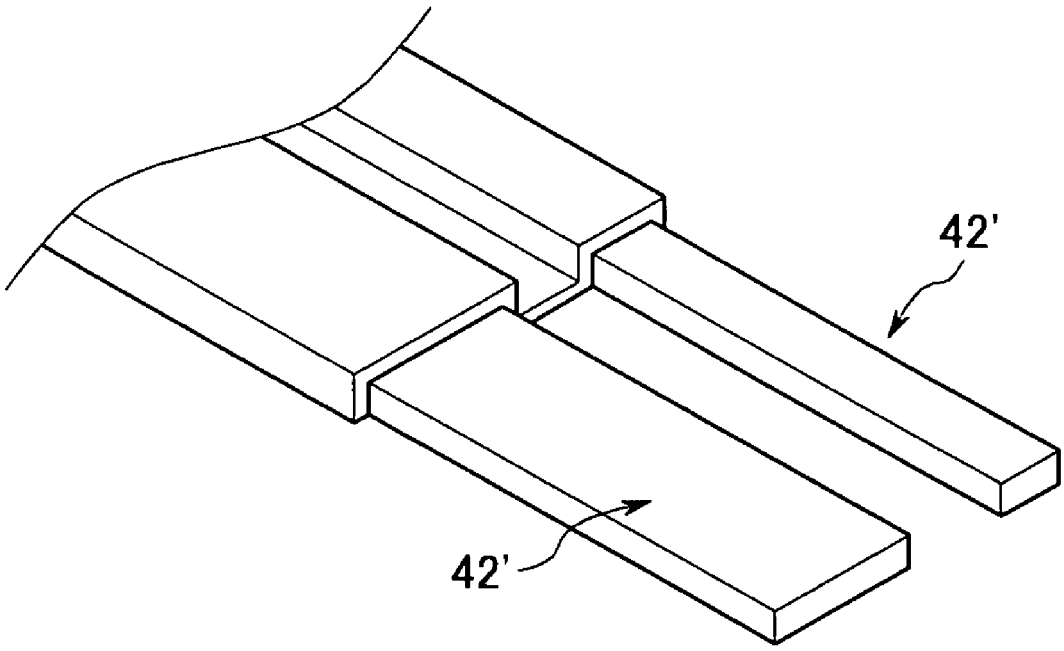
FIG. 4 is a partially broken perspective view of a modified example of the cathode electrode of FIG. 3.

Alternatively, as shown in FIG. 4, the metal electrode 42' may include a pair of sections arranged in parallel with each other with an interval (or a predetermined interval) therebetween (e.g., the metal electrode 42' includes two line electrodes spaced apart from each other).

Referring back to FIG. 3, the metal electrode 42 may be formed of a lower conductive material such as Ag, Al, Cr, and Pt.

The resistive layer 44 includes a first resistive layer 442 covering the metal electrodes 42 and a second resistive hole 444 formed in the holes 422 of the metal electrode and connected to the first resistive layer 442.

The first resistive layer 442 is formed on the metal electrodes 42 along the pattern of the metal electrodes 42 to reduce or prevent a material of the metal electrodes 42 from diffusing to the insulation layer 6 during a firing process for forming the insulation layer 6, thereby preventing a short circuit between gate, focusing, and/or cathode electrodes. Therefore, in one embodiment of the present invention, the first resistive layer 442 is formed to fully cover the metal electrodes 42.

The second resistive layer 444 is electrically connected to the first resistive layer 442 while filling the holes 422 of the metal electrodes 42.

Figure 5:
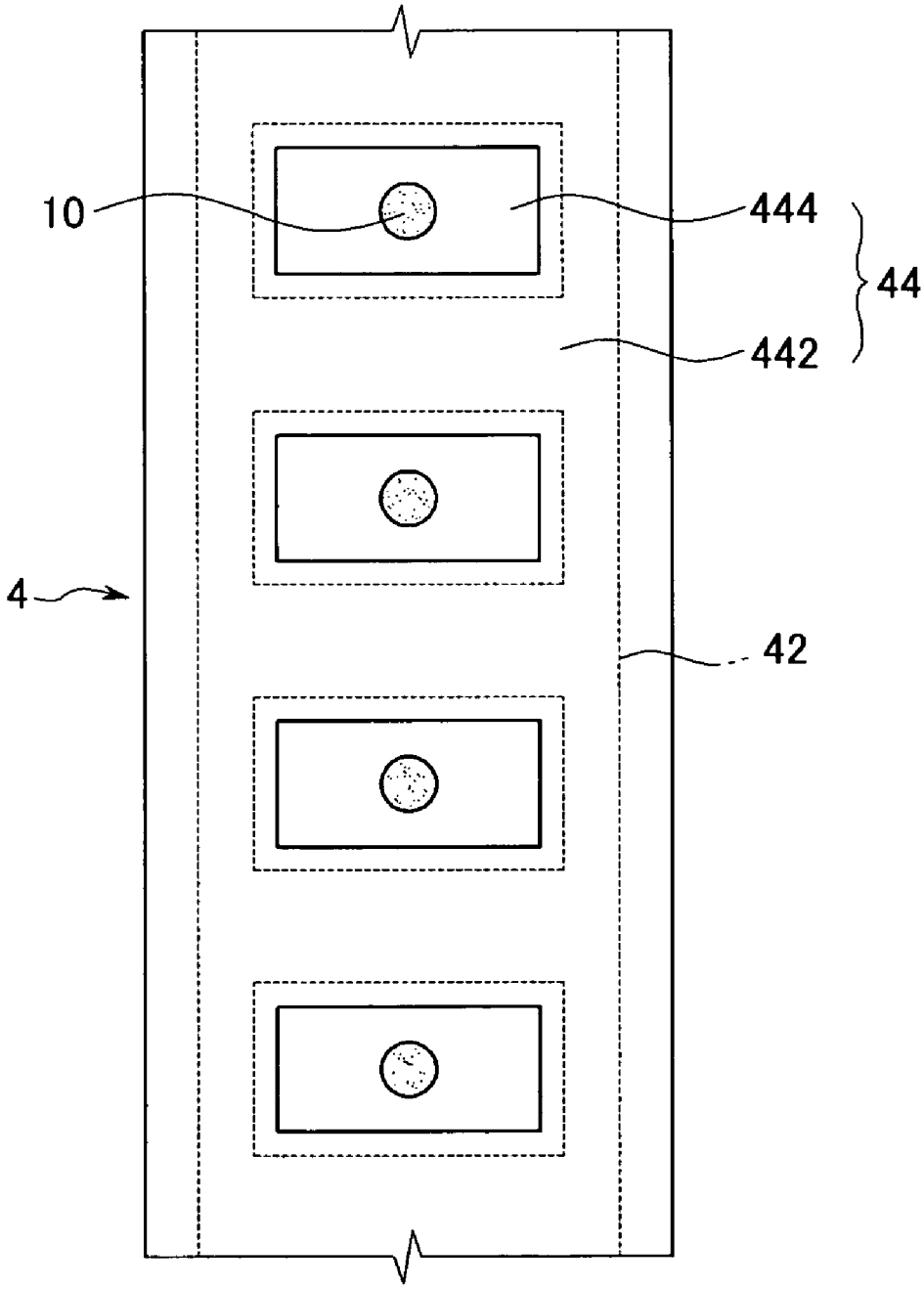
FIG. 5 is a top view of a cathode electrode and an electron emission region of the electron emission device of FIG. 1.

Referring also to FIG. 5, the electron emission regions 10 may be disposed on the second resistive layer 44. That is, the electron emission regions 10 do not directly contact the metal electrode 42 but are electrically connected to the metal electrode 42 via the resistive layer 44. In FIG. 5, the metal electrode 42 is shown by a dotted line.

As described above, since the resistive layer 44 is interposed between the electron emission regions 10 and the metal electrodes 42, an amount of electrons emitted from the emission regions 10 can be controlled by adjusting a resistance of the resistive layer 44 and a distance between the metal electrodes 42.

Here, the resistive layer 44 functions (or can be used) to make the amount of electron emission at each pixel uniform and to improve the electron emission uniformity of the electron emission device.

The metal electrodes 42 are formed by depositing a metal layer on the substrate 2 in a pattern (or a predetermined pattern) through a vapor deposition process, and the holes 422 are formed in the metal layer by using a mask layer. The resistive layer 44 is formed by depositing a resistive material to cover the metal electrodes 42 and patterning the resistive layer using a mask layer.

In the process of forming the resistive layer, the first and second resistive layers 442 and 444 are formed of an identical material to increase fabrication efficiency. That is, since the resistive layer 44 can be formed both on the metal electrode 42 as well as the hole 422 at about the same time through the vapor deposition process, the fabrication process can be simplified.

The resistive layer 44 may be formed of amorphous silicon (a-Si), but the present invention is not limited thereto. When the amorphous silicon is used, the resistance of the resistive layer 44 can be adjusted through a doping process. In this case, phosphorus (P) may be used as a dopant and a doping amount can be adjusted by adjusting an amount of doping gas such as $PH_3$.

Referring back to FIG. 1, the electron emission device 51 further includes another insulation layer 12 formed on the insulation layer 6 to cover the gate electrodes 8, and a focusing electrode 14 formed on the insulation layer 12. Openings 122 and 142 corresponding to the crossing regions are respectively formed in the insulation layer 12 and the focusing electrode 14.

The focusing electrode 14 may be formed on an entire surface of the insulation layer 12, or may be formed in a pattern (or a predetermined pattern) having a plurality of sections.

The electron emission device 51 can be applied to an electron emission display to emit light and display an image.

Figure 6:
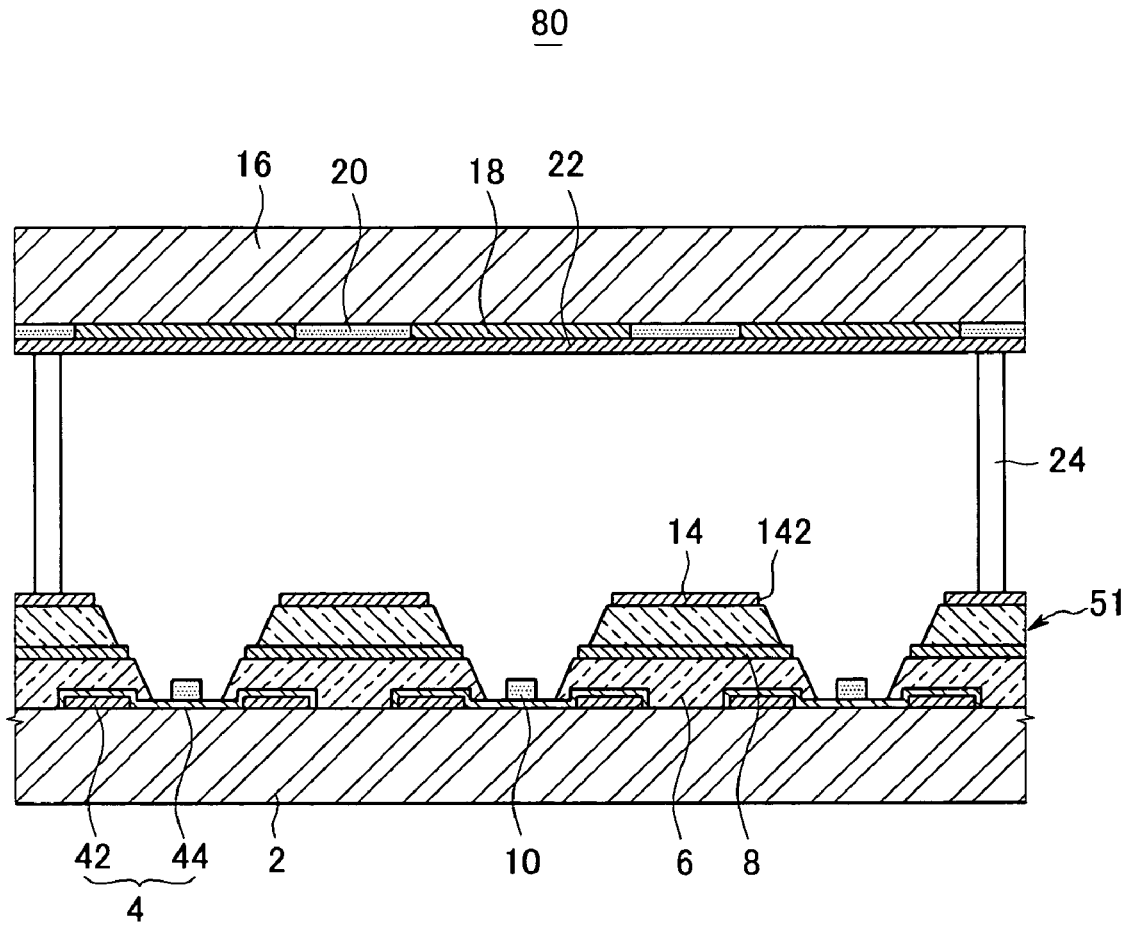
FIG. 6 is a partial sectional view of an electron emission display using the electron emission device of FIG. 1.

FIG. 6 is a partial sectional view of an electron emission display using the electron emission device 51 of FIG. 1.

In the following description, the substrate 2 of the electron emission device 51 will be referred as being a first substrate.

Referring to FIG. 6, an electron emission display 80 according to an embodiment of the present invention includes the first substrate 2 and a second substrate 16.

A sealing member (not shown) is provided at the peripheries of the first and second substrates 2 and 16 to seal them together and to thus form a sealed vacuum vessel (or a vacuum chamber). The interior of the vacuum vessel is made to have a degree (or a predetermined degree) of vacuum by exhausting air therefrom.

A light emission unit for emitting light using electrons emitted from the light emission regions 10 is provided on the second substrate 16.

In the light emission unit, red (R), green (G), and blue (B) phosphor layers 18 are formed on a surface of the second substrate 16 facing the first substrate 2, and black layers 20 for enhancing the contrast of the screen are arranged between the R, G, and B phosphor layers 18. The phosphor layers 18 may be formed corresponding to sub-pixels or formed in a stripe pattern.

An anode electrode 22 formed of a conductive material such as aluminum is formed on the phosphor and black layers 18 and 20. To heighten the screen luminance, the anode electrode 22 receives a high voltage required for accelerating the electron beams, and reflects the visible light rays radiated from the phosphor layers 18 to the first substrate 2 toward the second substrate 16.

Alternatively, the anode electrode 22 can be formed of a transparent conductive material, such as Indium Tin Oxide (ITO), instead of the metallic material. In this case, the anode electrode 22 is placed on the second substrate 16 and the phosphor and black layers 18 and 20 are formed on the anode electrode 22.

Alternatively, the anode electrode 22 is formed of a transparent conductive material, and the electron emission display may further include a metal layer for enhancing the luminance.

Disposed between the first and second substrates 2 and 16 are spacers 24 for uniformly maintaining a gap therebetween. The spacers 24 are arranged corresponding to the black layers 20 so that the spacers 24 do not encroach on the phosphor layers 18.

The above-described electron emission display 80 is driven when a voltage (or a predetermined voltage) is applied to the cathode, gate, focusing, and anode electrodes 4, 8, 34, 14, and 22. For example, either the cathode electrodes 4 or the gate electrodes 8 can serve as scan electrodes for receiving a scan drive voltage while the other can serve as data electrodes for receiving a data drive voltage.

Also, the focusing electrode 14 may receive a 0 voltage or a negative direct current voltage from several to tens of volts, and the anode electrode 22 may receive a positive direct current voltage from hundreds to thousands of positive volts to accelerate the electron beams.

Then, electric fields are formed around the electron emission regions 10 of pixels where a voltage difference between the cathode and gate electrodes 4 and 8 is higher than a threshold value, and thus the electrons are emitted from the electron emission regions 10. The emitted electrons strike the phosphor layers 18 of the corresponding pixels because of the high voltage applied to the anode electrode 22, thereby exciting the phosphor layers 18.

As described above, in the electron emission display 80, since the cathode electrode 4 includes the higher conductive metal electrode 42 and the resistive layer 44 for controlling the intensity of the current applied to the electron emission regions 10, the electron emission uniformity of the pixels is improved, thereby minimizing the luminance difference between the pixels and thus improving the display quality.

Figure 7:
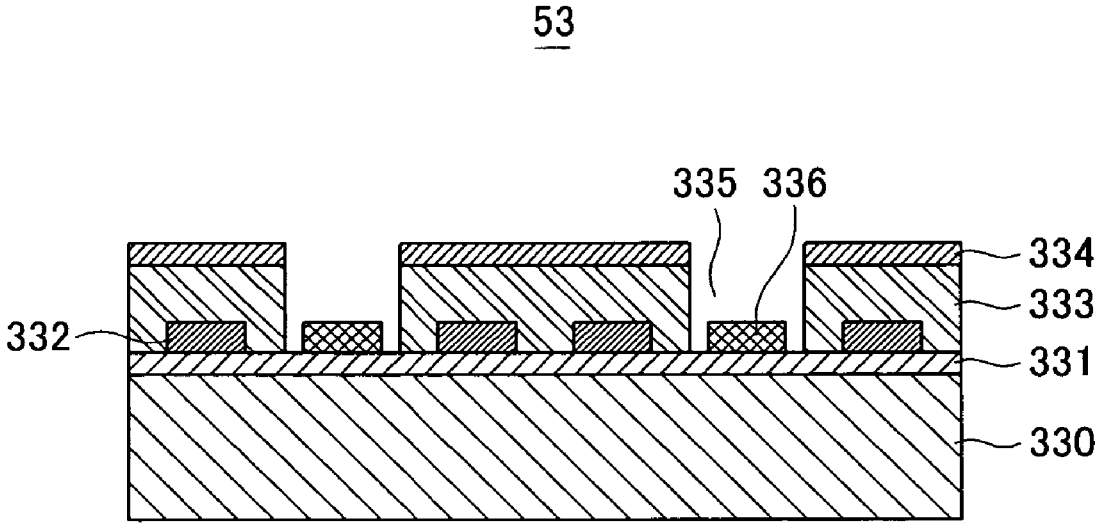
FIG. 7 is a schematic view of an electron emission device according to another embodiment of the present invention.

FIG. 7 is a schematic view of an electron emission device 53 according to another embodiment of the present invention.

Referring to FIG. 7, the electron emission device 53 includes a substrate 330, cathode electrodes 331 formed by depositing a conductive material on the substrate 330, sub-electrodes 332 formed of a metal oxide material on the cathode electrodes 331, an insulation layer 333 formed covering the sub-electrodes 332 and having insulation holes 335 for partially exposing the cathode electrodes 331, gate electrodes 334 formed of a metal material on the insulation layer 333, and electron emission regions 336 disposed on the cathode electrodes 331 through the insulation holes 335.

The substrate 330 may be formed of glass or silicon. For example, when the electron emission regions 336 are formed of a carbon nanotube (CNT) paste through a rear surface light exposing process, the substrate 330 may be formed of a transparent material such as glass.

The cathode electrodes 331 may be spaced at certain (or predetermined) intervals on the substrate 330. A data or scan signal is applied from a data or scan driving unit to the cathode electrodes 331. The cathode electrode 331 may be formed of a transparent conductive material such as ITO.

The sub-electrodes 332 are formed of a metal oxide material such as $TiO_2$ or TiN on the cathode electrodes 331 in a pattern (or a predetermined pattern). The sub-electrodes 332 ensure that the cathode electrodes 331 have a certain (or predetermined) resistance so as to reduce or prevent an input signal to the cathode electrodes 331 from being distorted.

The insulation layer 333 is formed on the cathode electrodes 331 and the sub-electrodes 332 to electrically insulate the cathode electrodes 331 from the gate electrodes 334. The insulation layer 333 may be formed of an insulation material such as PbO and $SiO_2$. In FIG. 7, the sub-electrodes 332 are fully covered with the insulation layer 333.

The gate electrodes 334 are formed on the insulation layer 333 in a stripe pattern to cross the cathode electrodes 331. Here, the gate electrodes 334 may be formed of a conductive metal material selected from the group consisting of Ag, Mo, Al, Cr, and alloys thereof. A data or scan signal is applied from a data or scan driving unit to the gate electrodes 334.

The electron emission regions 336 electrically contact the exposed portions of the cathode electrodes 331. For example, the electron emission regions 336 can be formed of carbon nanotubes, graphite, graphite nanofibers, diamonds, diamond-like carbons, $C_{60}$, silicon nanowires, or combinations thereof.

FIGS. 8A through 8E are views illustrating a method of fabricating the electron, emission device 53 of FIG. 7.

The electron emission device 53 may be formed through a thick or thin film process. In the thick film process, insulation paste is applied through a screen-printing process to form the thick insulation layer. In the thin film process, an insulation layer such as a silicon oxide layer is thinly deposited through chemical vapor deposition.

Figure 8A:
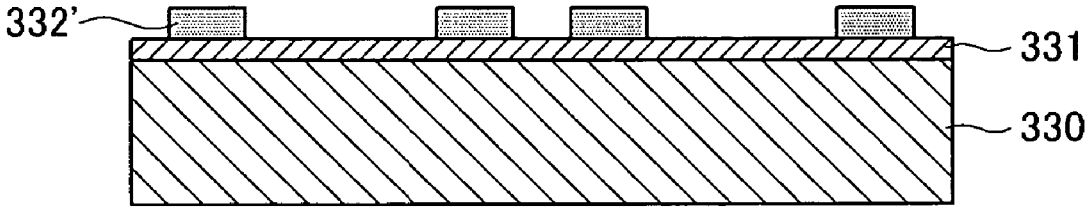
FIGS. 8A, 8B, 8C, 8D, and 8E are views illustrating a method of fabricating the electron emission device of FIG. 7.

As shown in FIG. 8A, the cathode electrodes 331 and the sub-electrodes 332 are consecutively formed on the substrate 330. Here, the substrate 330 is a transparent glass substrate for the rear surface light exposing process. The cathode electrodes 331 are formed of the ITO.

That is, the ITO is first deposited on the substrate 330 to a thickness ranging, for example, from 800 to 2000 Å, and the ITO layer is processed in a predetermined pattern (e.g., a stripe pattern). The patterning of the cathode electrodes 331 can be performed through a photolithography process.

Figure 8B:
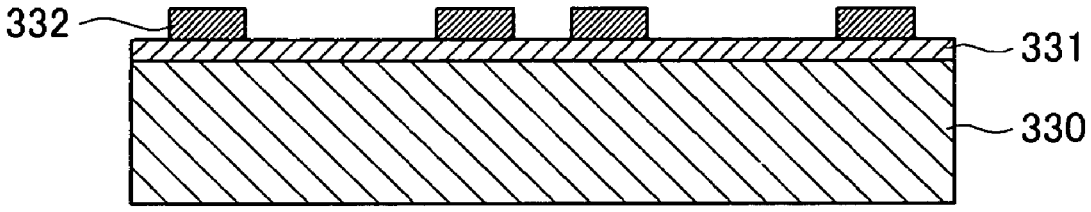

Then, as shown in FIG. 8B, the sub-electrodes 332 formed of $TiO_2$ or TiN are formed on the cathode electrodes 331. Here, the sub-electrodes 332 are formed by temporarily depositing Ti on the cathode electrodes 331 to form temporary sub-electrodes 332' as shown in FIG. 8A and oxidizing the temporary sub-electrodes 332' to $TiO_2$. Here, the sub-electrodes 332 function to ensure that the cathode electrodes 331 the resistance to reduce or prevent the input signal from being distorted. Here, the resistance of the cathode electrode 331 can range from 0.5 to 0.8 kΩ.

Figure 8C:
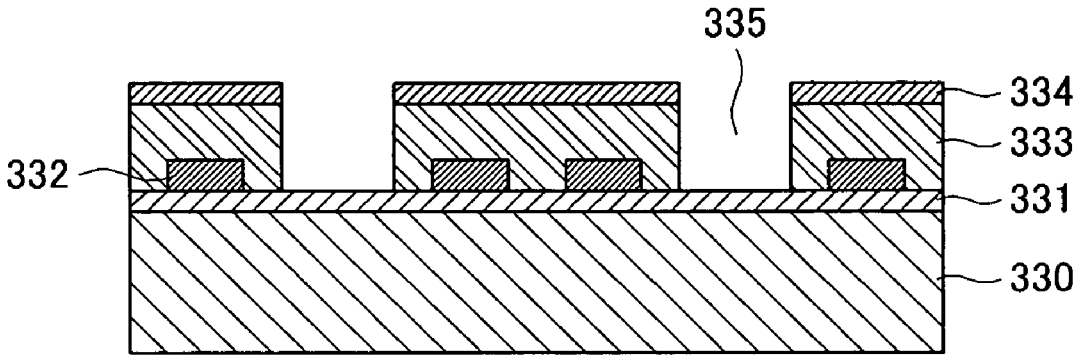

Next, as shown in FIG. 8C, the insulation layer 333 is formed on the cathode electrodes 331 and the sub-electrodes to a certain (or predetermined) thickness. When the insulation layer 333 is formed through the thick film process, insulation paste is deposited to a certain (or predetermined) thickness through the screen-printing process and then the deposited pastes is fired to more than 550° C., thereby forming the insulation layer 333 having a thickness of about 15-20 μm. Here, the firing temperature may vary depending on the type of the insulation material.

After the above firing process, the gate electrodes 334 are formed on the insulation layer 333. The gate electrodes 334 may be formed of a conductive metal such as Ag, Mo, Al, Cr, and alloys thereof through a sputtering process. A thickness of the gate electrode 334 may range from 2500 to 3000 Å.

Then, a photoresist layer (not shown) is deposited on the gate electrodes 334, and a portion of the gate electrodes 334 and the insulation layer 333 is etched to expose a portion of the cathode electrodes 331 to form the insulation holes 335.

Next, the electron emission regions are formed on the gate electrodes 334 through the insulation holes 335.

Figure 8D:
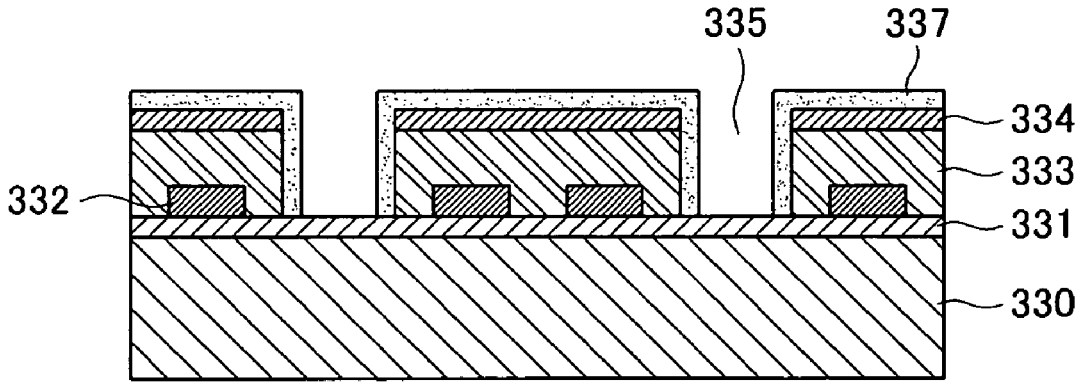

That is, from the state shown in FIG. 8C, the photoresist 337 is deposited and patterned to expose the cathode electrode 331 (see FIG. 8D).

Figure 8E:
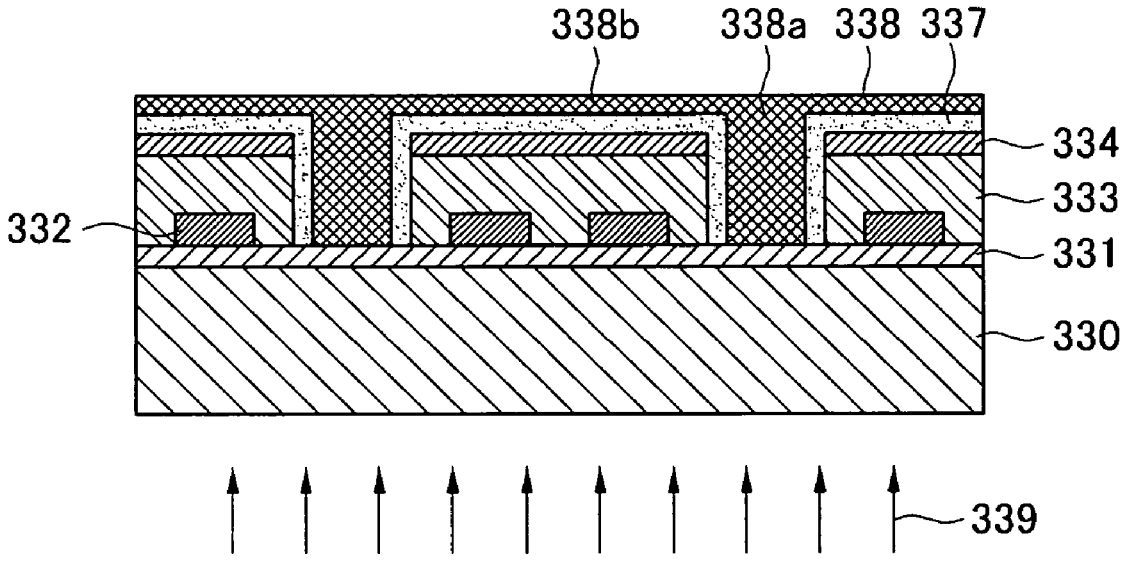

Next, as shown in FIG. 8E, a carbon nanotube (CNT) paste 338 is deposited on an entire surface of the resulting structure of FIG. 8D through the screen-printing process. Then, ultraviolet light 339 is irradiated to the rear surface of the substrate 330 so that the CNT paste can be selectively exposed to the light. Here, only an exposed portion **338*a* of the CNT paste 338 not covered by the photoresist 337 is exposed to the light and cured. When intensity of the ultraviolet light is controlled, the degree of light exposure of the CNT paste 338*a*** can be controlled. The thickness of the electron emission regions is determined in accordance to the degree of light exposure.

After the above process, when the photoresist is removed using a developing agent such as acetone, a non-exposed CNT paste portion **338*b* is also removed together with the photoresist and only the exposed portion 338*a* remains. Then, the firing process is performed at a temperature of about 460° C. to form the electron emission regions 336 shown in FIG. 7**. The firing temperature may vary according to the type and components of the CNT paste.

The electron emission device fabricated as described above can improve the electron emission uniformity by allowing the cathode electrodes 331 to have a desired resistance using the sub-electrodes 332.

Furthermore, since the sub-electrodes 332 are formed using the metal oxide material, the diffusion of the material of the sub-electrodes 332 to the insulation layer 33 can be reduced or prevented during the process for fabricating the electron emission device to thereby also prevent a short circuit between the electrodes (e.g., the cathode and gate electrodes).

Figure 9:
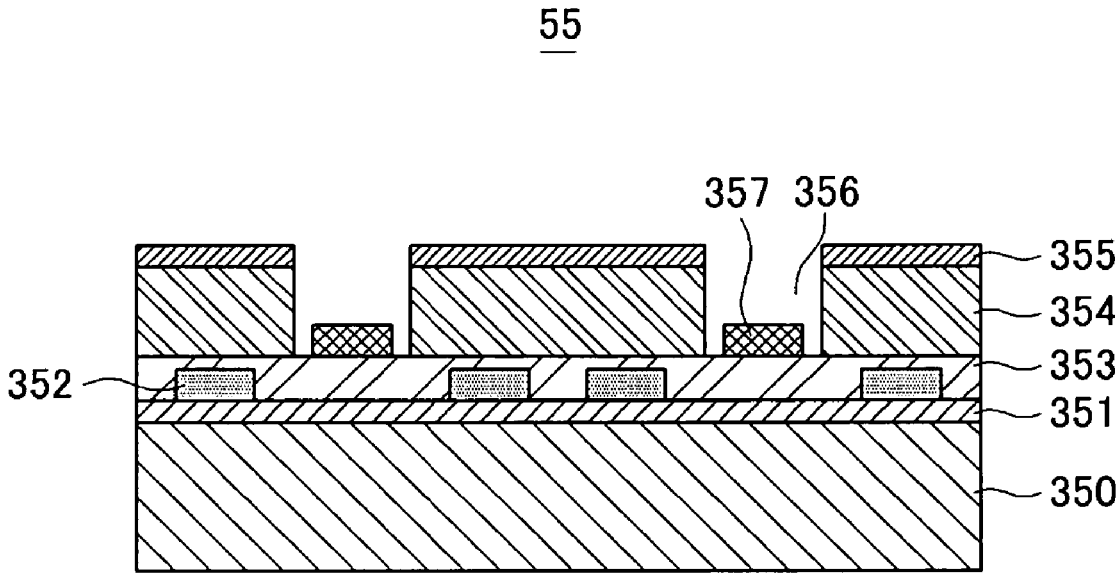
FIG. 9 is a schematic view of an electron emission device according to another embodiment of the present invention.

FIG. 9 is a schematic view of an electron emission device 55 according to another embodiment of the present invention;

Referring to FIG. 9, the electron emission device 55 includes a substrate 350, cathode electrodes 351 formed by depositing a conductive material on the substrate 350, sub-electrodes 352 formed by depositing a metal material on the cathode electrodes 351, a metal oxide layer 353 formed on the sub-electrodes 352, an insulation layer 354 having insulation holes 356 for partially exposing the metal oxide layer 353, gate electrodes 355 formed of a metal material on the insulation layer 354, and electron emission regions 357 disposed on the metal oxide layer 353 through the insulation holes 356.

Since this embodiment is substantially the same as to that of FIG. 7, only the parts of the embodiment of FIG. 9 that are different from that of FIG. 7 will be described hereinafter.

In the embodiment of FIG. 9, the metal oxide layer 353 is formed of $TiO_2$, TiN, or $SiO_2$. Since the metal oxide layer 353 can reduce or prevent the material of the sub-electrodes 352 from diffusing to the insulation layer 354 during a firing process for forming the insulation layer 354, the voltage withstanding property of the insulation layer 354 can be ensured and thus a short circuit between the electrodes 351 and 355 can be prevented.

FIGS. 10A through 10E are views illustrating a method of fabricating the electron emission device 55 of FIG. 9.

Figure 10A:
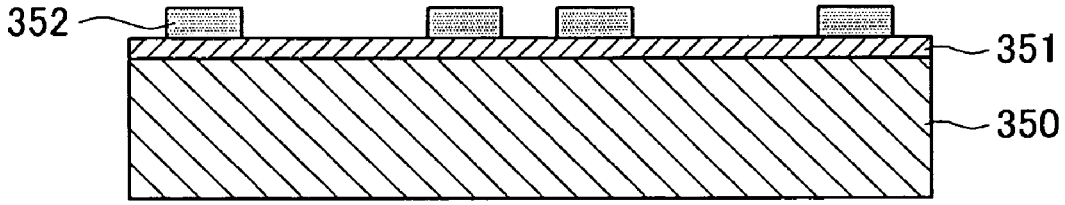
FIGS. 10A, 10B, and 10C are views illustrating a method of fabricating the electron emission device of FIG. 9.

As shown in FIG. 10A, the cathode electrodes 351 and the sub-electrodes 352 are successively (or sequentially or consecutively) formed on the substrate 350. Here, the substrate 350 is a transparent glass substrate for forming the electron emission regions 357 through the rear surface light exposing process. The cathode electrodes 351 can be formed of the ITO.

That is; the ITO is first deposited on the substrate 350 to a thickness, for example, ranging from 800 to 2000 Å and the ITO layer is processed in a predetermined pattern (e.g., a stripe pattern). Here, the patterning of the cathode electrodes 351 can be performed through a photolithography process.

A metal material such as Ag or Cr is deposited on the cathode electrodes 351 to form the sub-electrodes 352 in a predetermined pattern. The sub-electrodes 352 ensure that the cathode electrodes 351 have the resistance to reduce or prevent the distortion of the input signal. Here, the resistance of the cathode electrode 331 can range from 0.5 to 0.8 kΩ.

Figure 10B:
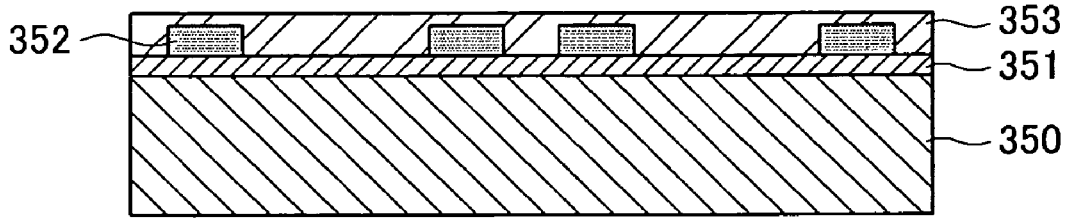

Then, as shown in FIG. 10B, the metal oxide layer 353 is formed on the sub-electrodes 352. The metal oxide layer 353 can be formed of $TiO_2$, TiN, or $SiO_2$.

Figure 10C:
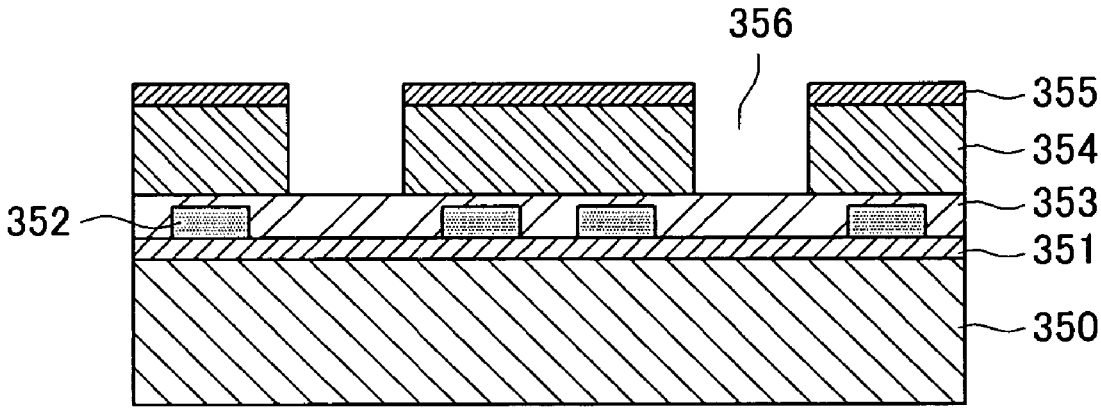

Then, as shown in FIG. 10C, the insulation layer 354 and the gate electrodes 355 are formed above the metal oxide layer 353 and the electron emission regions 357 are formed on the metal oxide layer 353 through the insulation holes 356 of the insulation layer, thereby completing the electron emission device 55 of FIG. 9.

Since the processes for forming the insulation layer 354, the gate electrodes 355, and the electron emission regions 357 are substantially identical to the embodiment of FIG. 7, the detailed description thereof will not be provided again.

Figure 11:
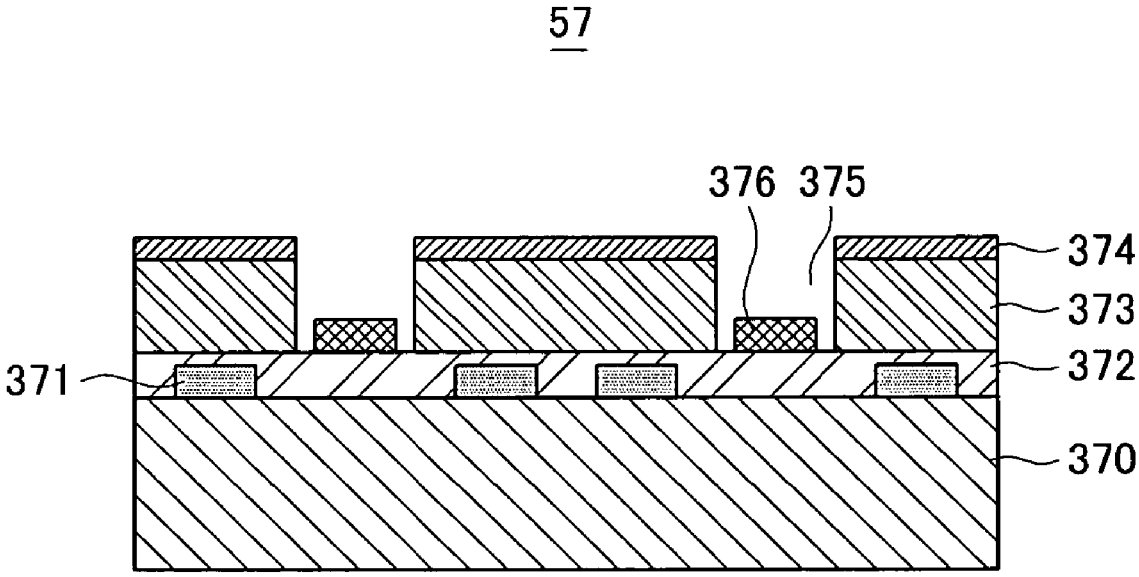
FIG. 11 is a schematic view of an electron emission device according to another embodiment of the present invention.

FIG. 11 is a schematic view of an electron emission device 57 according to another embodiment of the present invention.

Referring to FIG. 11, the electron emission device 57 includes a substrate 370, sub-electrodes 371 formed by depositing a metal oxide material on the substrate 370, cathode electrodes 372 formed by depositing a conductive material on the substrate 370 and covering the sub-electrodes 371, an insulation layer 373 formed on the cathode electrodes and having insulation holes 375 for partially exposing the cathode electrodes 372, gate electrodes 374 formed of a metal material on the insulation layer 373, and electron emission regions 376 disposed on the cathode electrodes 372 through the insulation holes 375.

Figure 12A:
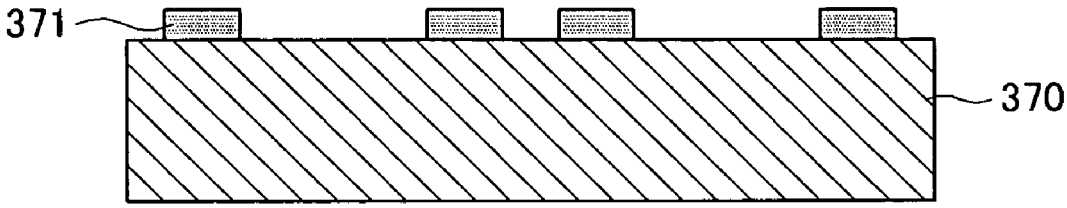
FIGS. 12A, 12B, and 12C are views illustrating a method of fabricating the electron emission device of FIG. 11.
Figure 12B:
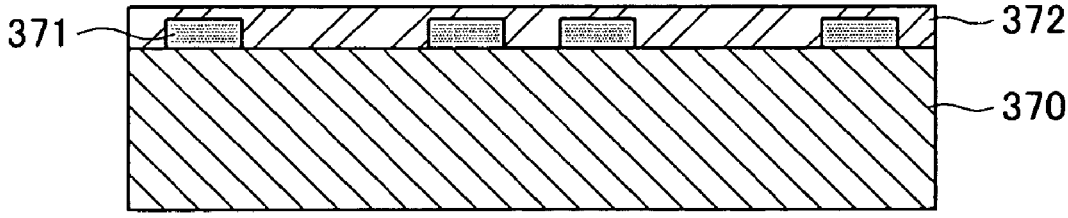
Figure 12C:
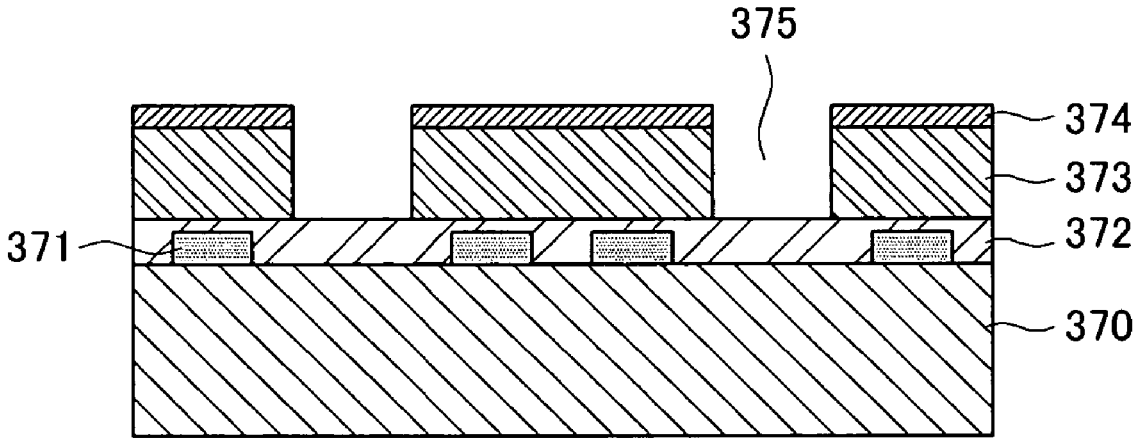

FIGS. 12A through 12C are views illustrating a method of fabricating the electron emission device 57 of FIG. 11.

As shown in FIG. 12A, the sub-electrodes 371 are formed on the substrate 370 by depositing a metal material such as Ag, Al, or Mo.

Then, as shown in FIG. 12B, ITO is deposited on the substrate 370 to cover the sub-electrodes 371 to a thickness, for example, ranging from 800 to 2000 Å, and the ITO layer is processed in a predetermined pattern (e.g., a stripe pattern).

The patterning of the sub-electrodes 371 can be performed through a photolithography process.

The insulation layer 373, the gate electrodes 374 (see FIG. 12C), and the electron emission regions (see FIG. 11) are formed through processes substantially identical to those of the foregoing embodiments. Therefore, the detailed description thereof will not be provided again.

According to this embodiment, the sub-electrodes 371 are formed on the substrate 370 in advance of forming the cathode electrodes 372, and the cathode electrodes 372 reduce or prevent a material of the sub-electrodes 371 from diffusing to the insulation layer 373, thereby preventing a short circuit between the electrodes.

Figure 13:
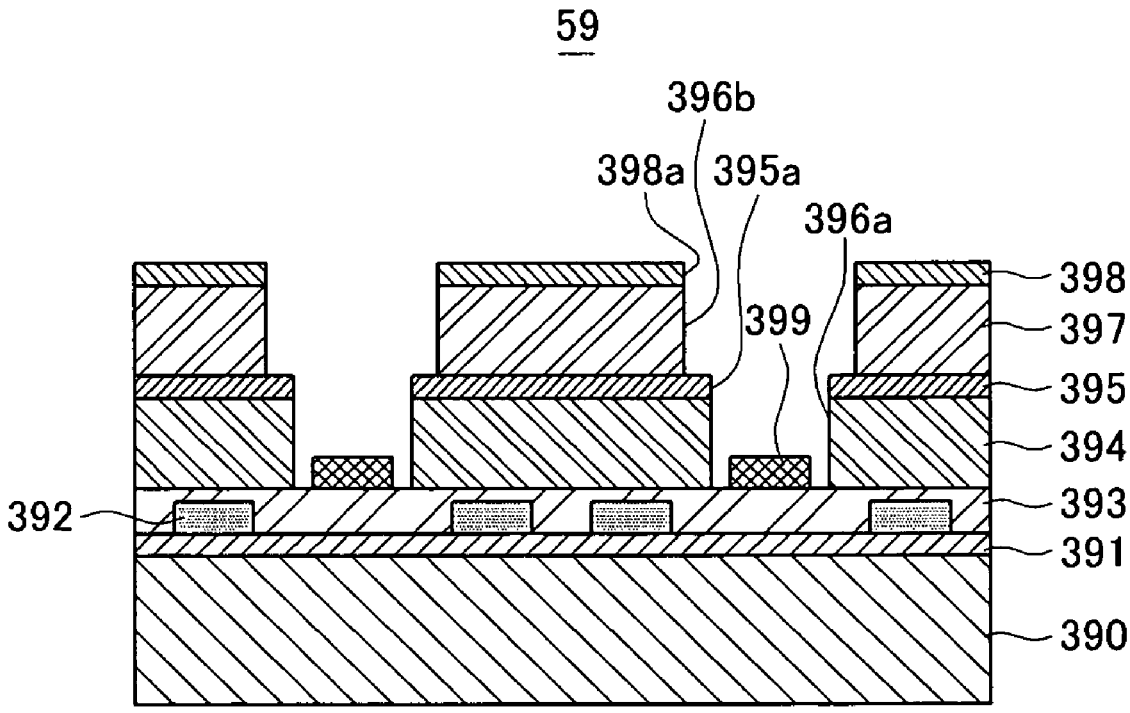
FIG. 13 is a schematic view of an electron emission device according to another embodiment of the present invention.

FIG. 13 is a schematic view of an electron emission device according to another embodiment of the present invention.

Referring to FIG. 13, the electron emission device 59 includes a substrate 390, cathode electrodes 391 formed by depositing a conductive material on the substrate 390, sub-electrodes 392 formed of a metal material on the cathode electrodes 391, a transparent conductive layer 393 formed on the sub-electrodes 392, a first insulation layer 394 formed covering the sub-electrodes 392 and having first insulation holes 396*a* for partially exposing the transparent conductive layer 393, a first gate electrode 395 formed of a metal material on the first insulation layer 394 and having first openings 395*a* communicating with the first insulation holes 396*a*, a second insulation layer 397 formed of an insulation material on the first gate electrode 395 and having second insulation holes 396*b* corresponding to the first insulation holes 396*a* and the first openings 395*a*, a second gate electrode 398 formed of a metal material on the second insulation layer 397 and having second openings 398*a* communicating with the first insulation holes 396*a*, the first openings 395*a*, and the second insulation holes 396*b*, and electron emission regions 399 disposed on the transparent conductive layer 393 through the first insulation holes 396*a*.

The transparent conductive layer 393 is formed of the ITO on the cathode electrodes 391 while covering the sub-electrodes 392.

FIGS. 14A through 14D are views illustrating a method of fabricating the electron emission device of FIG. 13.

Figure 14A:
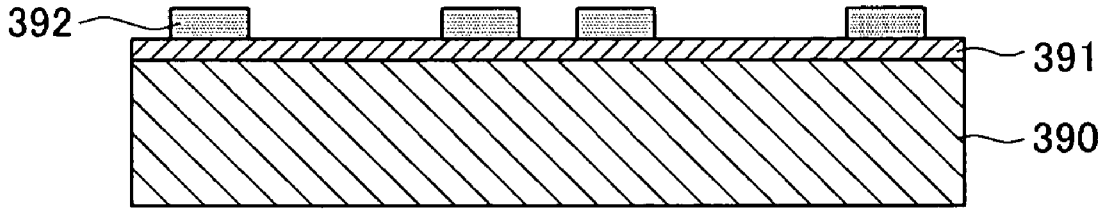
FIGS. 14A, 14B, 14C, and 14D are views illustrating a method of fabricating the electron emission device of FIG. 13.

As shown in FIG. 14A, the cathode electrodes 391 and the sub-electrodes 392 are consecutively formed on the substrate 390. Here, the substrate 390 is a transparent glass substrate for forming the electron emission regions 399 through the rear surface light exposing process. The cathode electrodes 391 are formed of the ITO.

That is, the ITO is first deposited on the substrate 390 to a thickness for example, ranging from 800 to 2000 Å, and the ITO layer is processed in a predetermined pattern (e.g., a stripe pattern). The patterning of the cathode electrodes 391 can be performed through a photolithography process.

Then, a metal material such as Ag or Cr is deposited in a predetermined pattern to form the sub-electrodes 392. Here, the sub-electrodes 392 function to ensure that the cathode electrodes 391 have the resistance to reduce or prevent the input signal from being distorted. The resistance of the cathode electrode 331 can range from 0.5 to 0.8 kΩ.

Figure 14B:
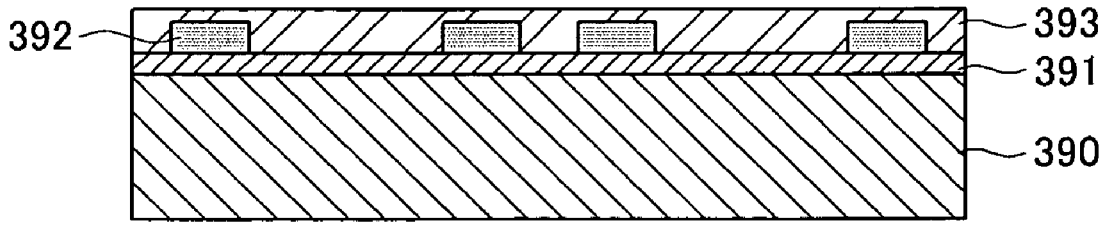

Next, as shown in FIG. 14B, the ITO is further deposited on the substrate 390 to a predetermined thickness through a sputtering process, thereby forming the transparent conductive layer 393.

Figure 14C:
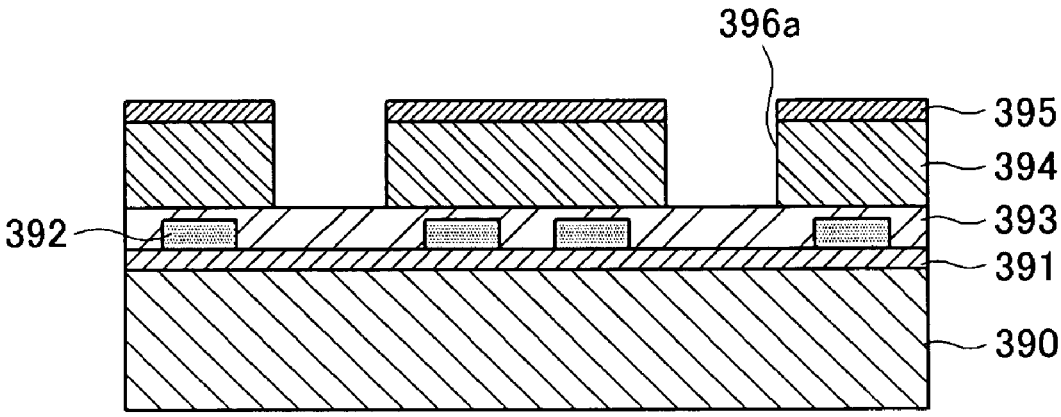

Next, as shown in FIG. 14C, the first insulation layer 394 is formed on the transparent conductive layer 393. When the first insulation layer 394 is formed through the thick film process, insulation paste is applied through the screen-printing process and sintered at a temperature above 550° C., thereby completing the first insulation layer 394 having a thickness ranging from 15 to 20 μm. The firing temperature may vary depending on the kind of the insulation material.

Then, the first gate electrode 395 is formed on the first insulation layer 394. The first gate electrode 395 may be formed to a thickness ranging from 2500 to 3000 Å by sputtering a conductive metal material selected from the group consisting of Ag, Mo, Al, Cr, and alloys thereof.

Figure 14D:
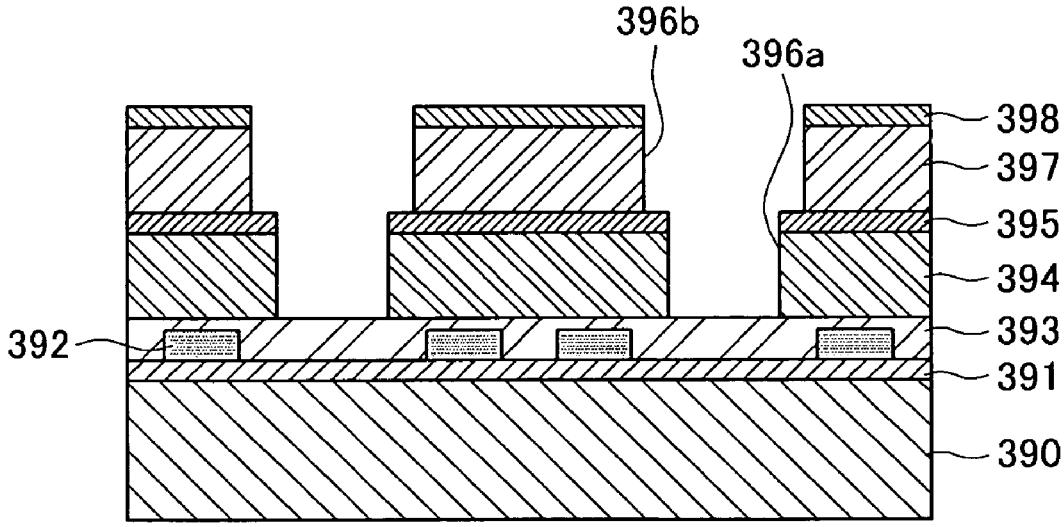

Next, as shown in FIG. 14D, the second insulation layer 397 and the second gate electrode 398 are formed on the first gate electrode 395. That is, the second insulation layer 397 is formed of $SiO_2$ and fired at a temperature ranging from 520 to 550° C.

After the above process, the electron emission regions 399 are formed on the transparent conductive layer 393 through the first insulation holes 396*a* of the first insulation layer 394, thereby completing the electron emission device 59 of FIG. 13.

As shown in FIG. 13, the electron emission device 59 has a dual gate structure. Alternatively, instead of the transparent conductive layer formed on the sub-electrodes, a layer formed of a $SiO_2$-based material can be provided.

In addition, the gate structure of this embodiment can be applied to one or more of the foregoing embodiments.

According to the present invention, since the diffusion of a material of the metal electrode to the insulation layer can be reduced or prevented during the firing process for forming the insulation layer, a short circuit between the electrodes can be prevented, thereby improving the reliability of the products.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission device comprising:

a cathode electrode comprising a conductive material on a substrate;

a sub-electrode comprising a metal oxide material on the cathode electrode, the cathode physically touching both the substrate and the sub-electrode;

a first insulation layer comprising an insulation material on the sub-electrode and having an insulation hole to expose a portion of the cathode electrode;

a first gate electrode comprising a metal material on the first insulation layer; and an electron emission region on the portion of the cathode electrode exposed through the insulation hole.

2. The electron emission device of claim 1, wherein the sub-electrode comprises $TiO_2$.

3. An electron emission device comprising:

a sub-electrode comprising a metal material on a substrate;

a cathode electrode comprising a conductive material between the substrate and the sub-electrode, the conductive material physically touching both the substrate and the sub-electrode;

a barrier layer comprising a metal oxide material or a metalloid oxide material on the sub-electrode;

a first insulation layer on the barrier layer and having an insulation hole to expose a portion of the barrier layer;

a first gate electrode comprising a metal material on the first insulation layer; and an electron emission region on the portion of the barrier layer exposed through the insulation hole of the first insulation layer.

4. The electron emission device of claim 3, wherein the barrier layer comprises $TiO_2$ or $SiO_2$.

5. An electron emission device comprising:

a sub-electrode comprising a metal material on a substrate;

a cathode electrode comprising a conductive material on the substrate, the conductive material physically touching both the substrate and the sub-electrode;

a first insulation layer on the cathode electrode and having an insulation hole to expose a portion of the cathode electrode;

a first gate electrode comprising a metal material on the first insulation layer; and an electron emission region on the portion of the cathode electrode exposed through the insulation hole.

6. An electron emission device comprising:

a sub-electrode comprising a metal material on a substrate;

a cathode electrode comprising a conductive material between the substrate and the sub-electrode, wherein the conductive material between the substrate and the sub-electrode comprises indium tin oxide;

a transparent conductive layer on the sub-electrode;

a first insulation layer on the transparent conductive layer and having an insulation hole to expose a portion of the transparent conductive layer;

a first gate electrode comprising a metal material on the first insulation layer; and an electron emission region on the portion of the transparent conductive layer exposed through the insulation hole.

7. The electron emission device of claim 6, wherein the transparent conductive layer comprises indium tin oxide.

8. The electron emission device of claim 6, further comprising a second insulation layer and a second gate electrode on the first gate electrode.

9. The electron emission device of claim 6, further comprising a second insulation layer and a second gate electrode on the first gate electrode.

* * * * *